US008561560B2

(12) United States Patent
Kawaguchi et al.

(10) Patent No.: US 8,561,560 B2
(45) **Date of Patent: *Oct. 22, 2013**

(54) WORKPIECE HOLDER

(75) Inventors: Yasuhiko Kawaguchi, Nagoya (JP); Hiroshi Yamasaki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 859 days.

This patent is subject to a terminal disclaimer.

(21) Appl. No.: 12/697,855

(22) Filed: Feb. 1, 2010

(65) Prior Publication Data

US 2010/0236462 A1 Sep. 23, 2010

(30) Foreign Application Priority Data

Mar. 23, 2009 (JP) ..... 2009-070255

(51) Int. Cl.
*D05B 19/00* (2006.01)

(52) U.S. Cl.
USPC ..... 112/470.05

(58) Field of Classification Search
USPC ..... 112/103, 73, 77, 78, 221, 222, 470.05, 112/475.07, 475.18; 72/446, 455, 379.2, 72/175
See application file for complete search history.

(56) References Cited

U.S. PATENT DOCUMENTS

| | | | |
|---|---|---|---|
| 6,820,565 | B1 | 11/2004 | Kawaguchi et al. |
| 7,484,466 | B2 | 2/2009 | Kuki et al. |
| 8,276,532 | B2 * | 10/2012 | Kawaguchi ..... 112/470.05 |

FOREIGN PATENT DOCUMENTS

| | | |
|---|---|---|
| JP | A 57-12156 | 1/1982 |
| JP | A 5-096071 | 4/1993 |
| JP | U-6-34830 | 5/1994 |
| JP | A-7-148534 | 6/1995 |
| JP | A 11-172566 | 6/1999 |
| JP | A 2002-052280 | 2/2002 |
| JP | A-2004-254987 | 9/2004 |
| JP | A 2005-146460 | 6/2005 |
| JP | A-2006-53417 | 2/2006 |
| JP | U-3130916 | 4/2007 |
| JP | A 2007-222189 | 9/2007 |
| JP | A-2008-280663 | 11/2008 |

OTHER PUBLICATIONS

Jul. 18, 2013 Office Action issued in U.S. Appl. No. 12/873,808.

* cited by examiner

*Primary Examiner* — Tejash Patel
(74) *Attorney, Agent, or Firm* — Oliff & Berridge, PLC

(57) ABSTRACT

A workpiece holder is usable with an embroidery sewing machine including a needle bar movable upward and downward and a transfer mechanism transferring the workpiece in two directions. The workpiece holder holds the workpiece when the workpiece is engraved by striking the workpiece by a striking needle attached to the needle bar while the workpiece is transferred by the transfer mechanism. The workpiece holder includes a pair of connecting portions detachably attached to the transfer mechanism, a placement member on which the workpiece is placed and a holding mechanism which is located on the placement member to hold a part of the workpiece other than a worked surface of the workpiece which is engraved, so that the part is fixed.

20 Claims, 12 Drawing Sheets

WORKPIECE HOLDER

CROSS-REFERENCE TO RELATED APPLICATIONS

This application is based upon and claims the benefit of priority from the prior Japanese Patent Application No. 2009-70255 filed on Mar. 23, 2009, the entire contents of which are incorporated herein by reference.

BACKGROUND

1. Technical Field

The present disclosure relates to a workpiece holder which is used with a sewing machine which includes a needle bar movable upward and downward and a transfer mechanism transferring a workpiece in predetermined two directions and which can execute an embroidery sewing, the workpiece holder holding the workpiece when the workpiece is engraved by vertically moving a striking needle attached to the needle bar while the workpiece is transferred.

2. Description of the Related Art

There has conventionally been provided a multi-needle embroidery sewing machine which can continuously execute embroidery sewing with the use of multicolor embroidery threads, for example. The multi-needle embroidery sewing machine is provided with a needle bar case which is mounted on a distal end of an arm and has, for example, six needle bars. A predetermined one of the needle bars is selectively coupled to a needle bar driving mechanism thereby to be vertically driven. Based on pattern data instructing a needle position for every stitch (that is, an amount of movement of workpiece cloth), color change and the like, a control device of the embroidery sewing machine controls the needle bar driving mechanism and other driving mechanisms while moving the embroidery frame holding workpiece cloth in the X and Y directions by a transfer mechanism, thereby executing a multicolor embroidery sewing operation. The aforesaid embroidery frame includes an inner frame and an outer frame both of which hold the workpiece cloth therebetween and is detachably attached to a carriage of the transfer mechanism in use.

An apparatus has recently been provided which engraves desired photograph, illustration, characters and the like on the surfaces of plastic or metallic plates and boards made of wood or fabric using striking needles, thereby producing accessories and furnishing goods.

Under the circumstances, the inventors conceived use of the aforementioned multi-needle embroidery sewing machine as an apparatus for performing the above-described engraving by attaching one or more striking needles to the needle bars, instead of the embroidery sewing needles. In this case, the needle bars to which the respective striking needles are attached are each moved up and down while the workpiece is moved by the transfer mechanism based on engraving data, whereby a predetermined pattern or the like is considered to be engraved on the surface of workpiece cloth.

However, the workpiece to be engraved is formed into the shape of a relatively harder plate such as plastic, metallic, wooden or fabric board. Accordingly, the aforesaid embroidery frame cannot be used to hold the workpiece, and a workpiece holder for holding a workpiece to be engraved is necessitated.

SUMMARY

Therefore, an object of the disclosure is to provide a workpiece holder suitable to hold the workpiece to be engraved when the workpiece is engraved by a sewing machine with an embroidery sewing function.

The present disclosure provides a workpiece holder which is usable with an embroidery sewing machine including a needle bar movable upward and downward and a transfer mechanism configured to transfer a workpiece in two directions, the workpiece holder being configured to hold the workpiece when the workpiece is engraved by striking the workpiece by a striking needle attached to the needle bar while the workpiece is transferred by the transfer mechanism, the workpiece holder comprising a pair of connecting portions detachably attached to the transfer mechanism; a placement member on which the workpiece is placed; and a holding mechanism which is provided on the placement member and configured to hold a part of the workpiece other than a worked surface of the workpiece which is engraved, so that said part is fixed.

DETAILED DESCRIPTION OF THE DISCLOSURE

Figure 3A:
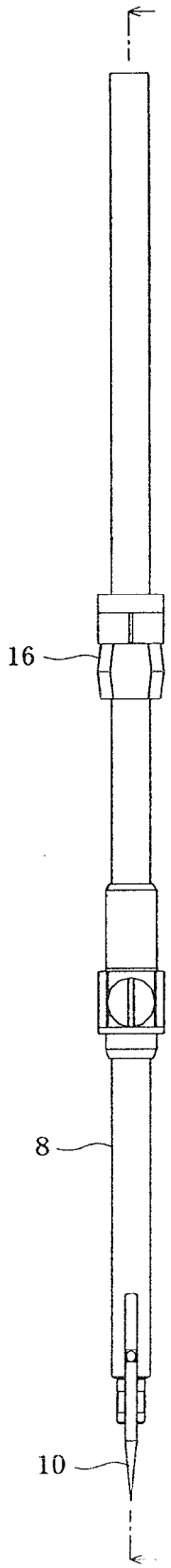
FIGS. 3A and 3B are a front view and a longitudinal right side section of the needle bar to which a striking needle is attached, respectively.
Figure 3B:
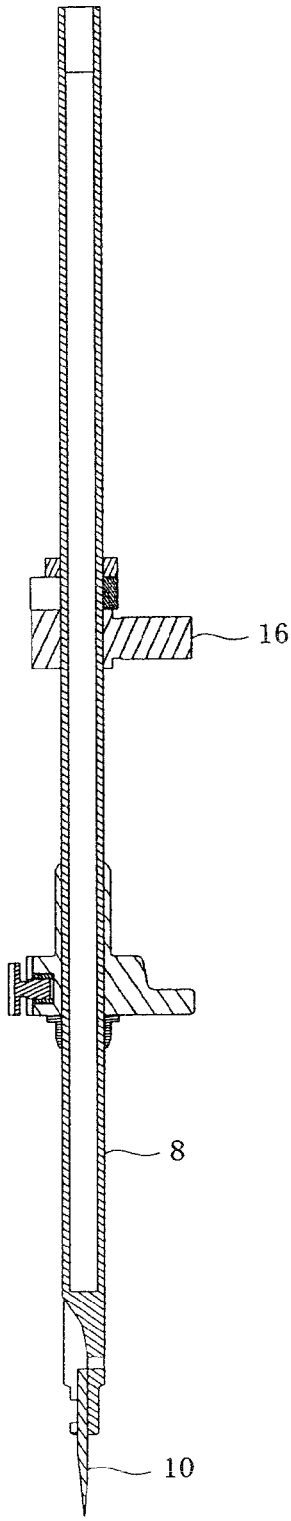
Figure 4:
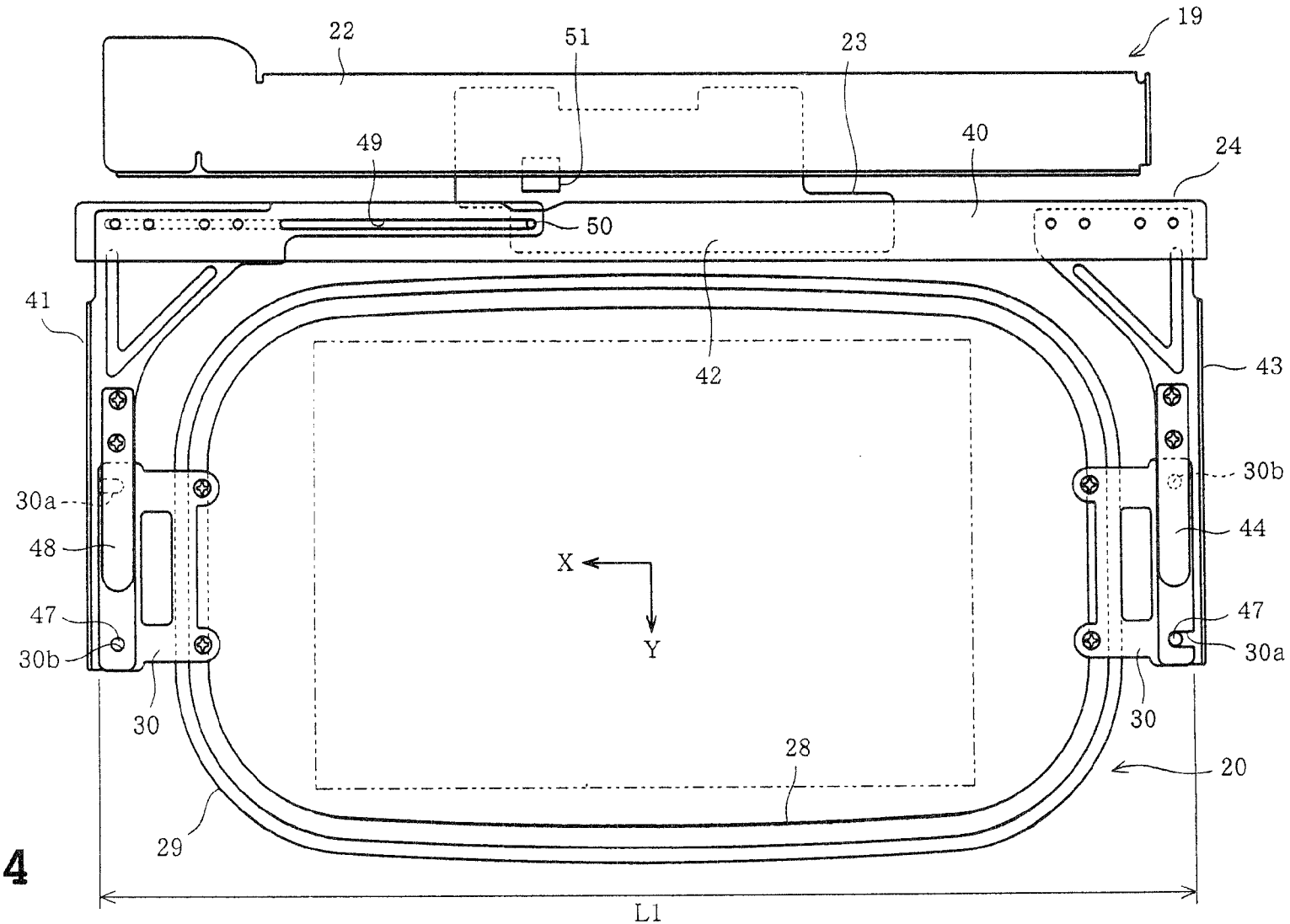
FIG. 4 is a plan view of an embroidery frame and a frame holder.

A first embodiment will be described with reference to FIGS. 1 to 9. In the following description, the right-left direction of a sewing machine body 1 will be referred to as "X direction" and the front-back direction thereof will be referred to as "Y direction" as shown in FIGS. 1, 2 and 4.

Figure 1:
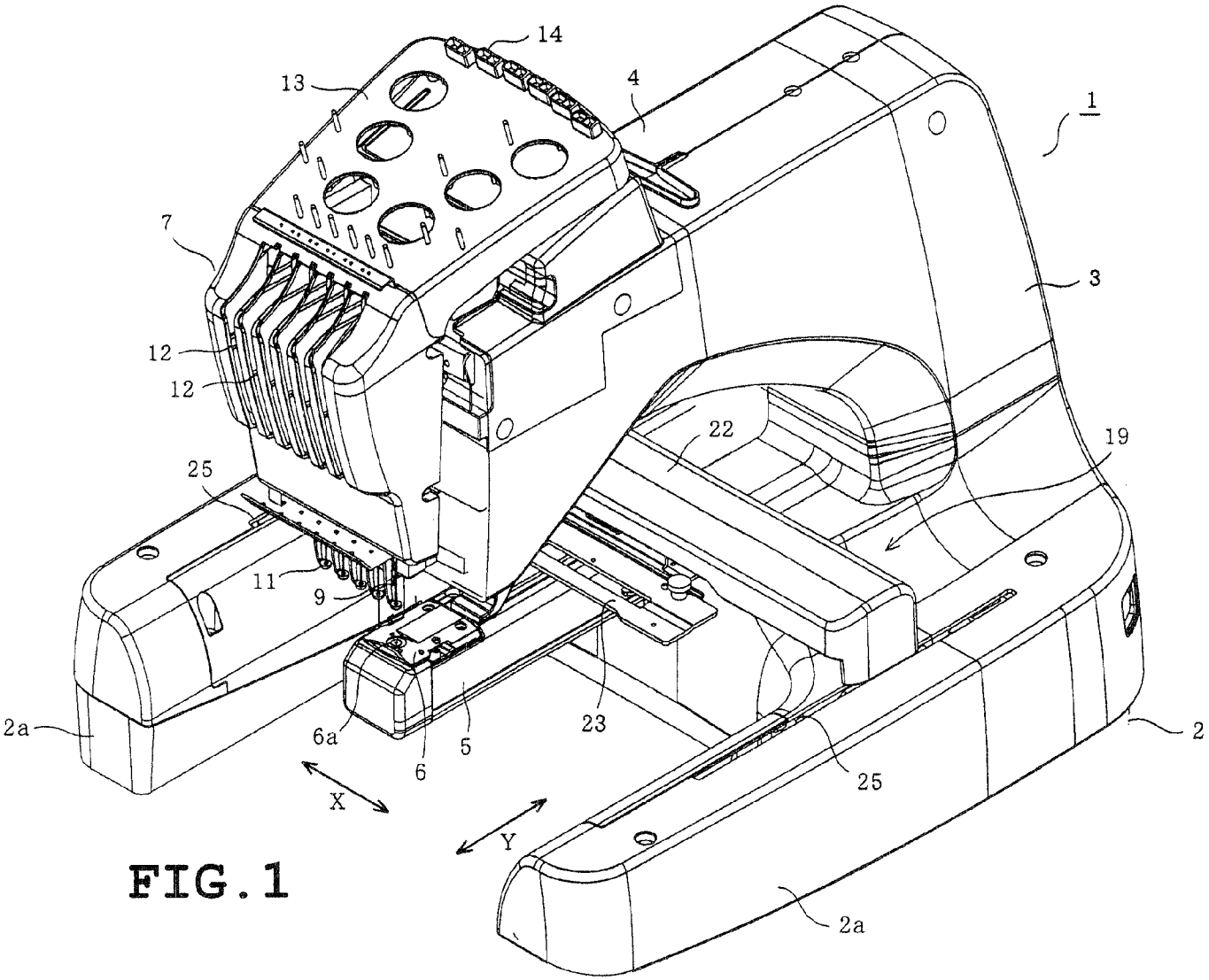
FIG. 1 is a perspective view of a sewing machine body of a first illustrative example.

Referring to FIG. 1, the sewing machine body 1 includes a support base 2 placed on a mounting base which is not shown, a pillar 3 standing upward from a rear end of the support base 2 and an arm 4 extending frontward from an upper end of the pillar 3. The support base 2 is formed substantially into a U-shape and has two legs 2*a* extending forward from right and left portions thereof and an open front as viewed from above. The support base further has a cylinder bed 5 which is formed integrally therewith and extends forward from the central rear thereof. A needle plate 6 having a needle hole 6*a* is mounted on an upper part of the distal end of the cylinder bed 5. The cylinder bed 5 encloses a thread loop taker, a thread cutting mechanism, a picker and the like although none of them are shown.

A spool device on which, for example, six thread spools are settable is mounted on an upper rear of the arm 4 although not shown. An operation panel is provided on the right of the arm 4. On the operation panel are provided a plurality of operation switches 56 which are operated by the user or operator for input of various instructions and selection and a liquid crystal display (LCD) 57 as shown in only FIG. 6.

Figure 2:
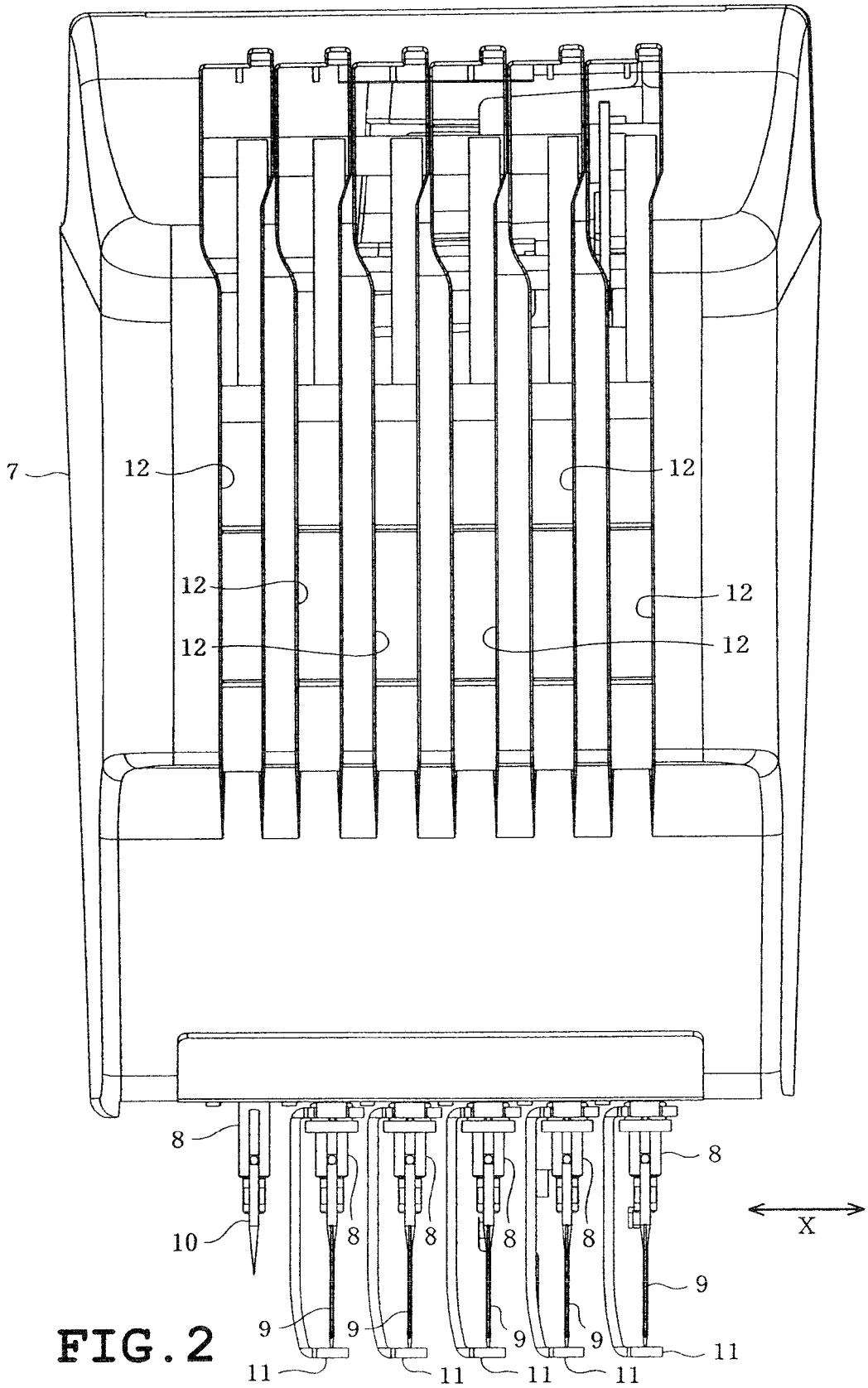
FIG. 2 is a front view of a needle bar case.

A needle bar case 7 is mounted on a distal end of the arm 4 so as to be movable in the right-left direction (the X direction) as shown in FIG. 2 as well as in FIG. 1. The needle bar case 7 is formed into the shape of a generally rectangular box that is thin in the front-back direction, as shown in FIG. 2. A plurality of, for example, six needle bars 8 which are lined up in the right-left direction and are supported in the needle bar case 7 so as to be movable upward and downward. Each needle bar 8 is normally urged toward a needle-up position (an upper dead point as shown in FIG. 2) by a coil spring that is not shown. The needle bars 8 have lower ends which protrude below the needle bar case 7 and on which embroidery needles 9 are detachably (replaceably) mounted, respectively. Needle bar Nos. 1, 2 and so on are assigned to the needles 9 sequentially from the right one when the needle bars 7 need to be identified from one another. In the embodiment, a striking needle 10 is attached to a specified leftmost needle bar 8 (needle bar No. 6) as shown in FIGS. 3A and 3B. The striking needle 10 will be described later.

Embroidery presser feet 11 are mounted on the lower portions of the needle bar 8 so as to be movable upward and downward in synchronization with the upward and downward movement of the needle bars 8 respectively. In this case, the embroidery presser foot 11 is adapted to be detached when the striking needle 10 is attached to the needle bar 8 of No. 6. Six thread take-up levers are provided in the upper interior of the needle bar case 7 so as to correspond to the respective needle bars 8 although not shown. The thread take-up levers have distal ends protruding forward through six vertical slits 12 formed in the front surface of the needle bar case 7, thereby being swung upward and downward in synchronization with the upward and downward movement of the needle bars 8, respectively. Additionally, a wiper is provided in the rear of the needle bar 8 occupying the position where the needle bars 8 is moved upward and downward by a needle bar upward and downward driving mechanism which will be described later.

The needle bar case 7 includes an upper cover 13 which is formed integrally therewith and extends obliquely rearward from an upper end thereof, as shown in FIG. 1. Six thread tensioners (only mounting holes therefore are shown) and six thread break detectors 14 are located on an upper end of the upper cover 13. As the result of the above-described construction, embroidery needle threads are drawn from respective thread spools set on a spool device and passed through respective thread break detectors 14, thread tensioners, thread take-up levers and the like sequentially. The needle threads are finally passed through the eyes of the needles 9 respectively, whereupon the embroidery sewing is executable. In this case, when different colors of threads are supplied to six or five needles 9, an embroidery sewing operation can continuously be carried out while the threads are automatically changed.

A sewing machine motor 15 (shown only in FIG. 6) is provided in the pillar 3 although not shown in detail. In the arm 4 are provided a main shaft driven by the sewing machine motor 15, a needle bar upward and downward driving mechanism which is driven by rotation of the main shaft thereby to move the needle bars 8 and the like upward and downward, a needle bar selecting mechanism which moves the needle bar case 7 in the X direction to select one of the needle bars 8, and the like. The thread loop taker is also driven in synchronization with the upward and downward movement of the needle bar 8 by the rotation of the main shaft.

The needle bar upward and downward driving mechanism includes an upward and downward moving member which is selectively engaged with a needle bar bracket 16 (see FIG. 3) of each needle bar 8. The needle bar selecting mechanism is driven by a needle bar selecting motor 17 (shown only in FIG. 6) to transfer the needle bar case 7 in the X direction so that any one of the needle bars 8 or the needle bar 8 located right above the needle hole 6*a* is engaged with the upward and downward moving member. The needle bar selecting mechanism is thus constructed, and only the selected needle bar 8 and the thread take-up lever corresponding to the selected needle bar 8 are moved upward and downward by the needle bar upward and downward driving mechanism.

A carriage 19 constituting a transfer mechanism is located slightly above the cylinder bed 5 on the support base 2 (in front of the pillar 3) as shown in FIG. 1. A holder is detachably connected to the carriage 19. The holder holds the workpiece, that is, workpiece cloth (not shown) on which embroidery is to be sewn or workpiece W (see FIGS. 5A to 5C) which is to be engraved. In the embodiment, the holder includes a plurality of types of embroidery frames 20 (only one type is shown in FIG. 4) and a workpiece holder 21 (see FIGS. 5A to 5G) which holds the workpiece W both of which are provided as accessories. The workpiece holder 21 of the embodiment will be described in detail later.

The carriage 19 includes a Y-direction carriage 22, an X-direction carriage 23 mounted on the Y-direction carriage 22 and a frame holder 24 (shown only in FIG. 4) mounted on the X-direction carriage 23 as shown in FIGS. 1 and 4. The carriage 19 further includes a Y-direction drive mechanism which is provided in the support base 2 to move the Y-direction carriage 22 freely in the Y direction (the front-back direction) and an X-direction drive mechanism which is provided on the Y-direction carriage 22. The holder holding the workpiece is held by the frame holder 24 and is freely transferred in two directions or the X and Y directions by the carriage 19.

The Y-direction carriage 22 is formed into the shape of a horizontally long box and extends in the right-left direction (the X direction) so as to bridge between the right and left legs 2*a*. In this case, the legs 2*a* of the support base 2 are formed with respective guide grooves 25 extending in the front-back direction (the Y direction) as shown in FIG. 1. The Y-direction drive mechanism includes two moving members which extend vertically through the guide grooves 25 and are provided so as to be movable in the Y--direction (the front-back direction) along the guide grooves 25, respectively. The Y-direction carriage 22 has right and left ends connected to upper ends of the moving members respectively.

The Y-direction drive mechanism includes a Y-direction drive motor 26 (see FIG. 6) comprising a stepping motor and a linear moving mechanism comprising a timing pulley and a timing belt. The moving member is freely moved by the linear moving mechanism driven by the Y-direction drive motor serving as a drive source, whereby the Y-direction carriage 22 is freely moved in the Y direction (the front-back direction).

The X-direction carriage 23 is formed into the shape of a horizontally long plate having a part thereof protruding forward from the lower front of the Y-direction carriage 22 as shown in FIGS. 1 and 4. The X-direction carriage 23 is supported by the Y-direction carriage 22 so as to be slidable in the K direction (the right-left direction). The X-direction drive mechanism provided in the Y--direction carriage 22 includes an X-direction drive motor 27 (see FIG. 6) comprising a stepping motor and a linear moving mechanism comprising a timing pulley and a timing belt. The X-direction drive mechanism freely moves the X-direction carriage 23 in the X direction (the right-left direction).

The following will describe the frame holder 24 mounted on the X-direction carriage 23 and the holding member detachably attached to the frame holder 24, that is, the embroidery frame 20 and the workpiece holder 21. Firstly, the embroidery frame 20 will be described with reference to FIG. 4. The embroidery frame 20 includes a rounded rectangular inner frame 28, an outer frame 29 detachably fitted with the outer periphery of the inner frame 28 and a pair of connecting portions 30 mounted on right and left ends of the inner frame 28 respectively. The workpiece cloth serving as the workpiece is held between the inner and outer frames 28 and 29 so as to be held in a stretched state inside the inner frame 28.

The paired connecting portions 30 have rotational symmetry through 180 degrees in a plan view. The connecting portions 30 are formed with respective engagement grooves 30*a* and engagement holes 30*b* for attachment to the frame holder 24. A plurality of types of embroidery frames 20 differing in the size and shape (embroidery area) from one another are prepared and selectively used according to a size of embroidery pattern. Furthermore, the width L1 or the dimension between the outer edges of the connecting portions 30 is set so as to differ from one embroidery frame to another according to the type of the connecting portions 30. As a result, detection as to the type of the embroidery frame and detection as to whether the workpiece holder are executable. FIG. 4 shows an embroidery frame 20 having a largest width L1.

Next, the workpiece holder 21 for holding the workpiece W on which engraving is carried out will be described with reference to FIGS. 5A to 5C and 7. The workpiece W has a rectangular plate shape and may be a plate made of a resin such as acrylic, a plate made of a metal such as aluminum or brass, a wooden plate or plyboard, a board made by solidifying a fibrous material. The workpiece W made of one of these materials desired by the user may be used.

Figure 5A:
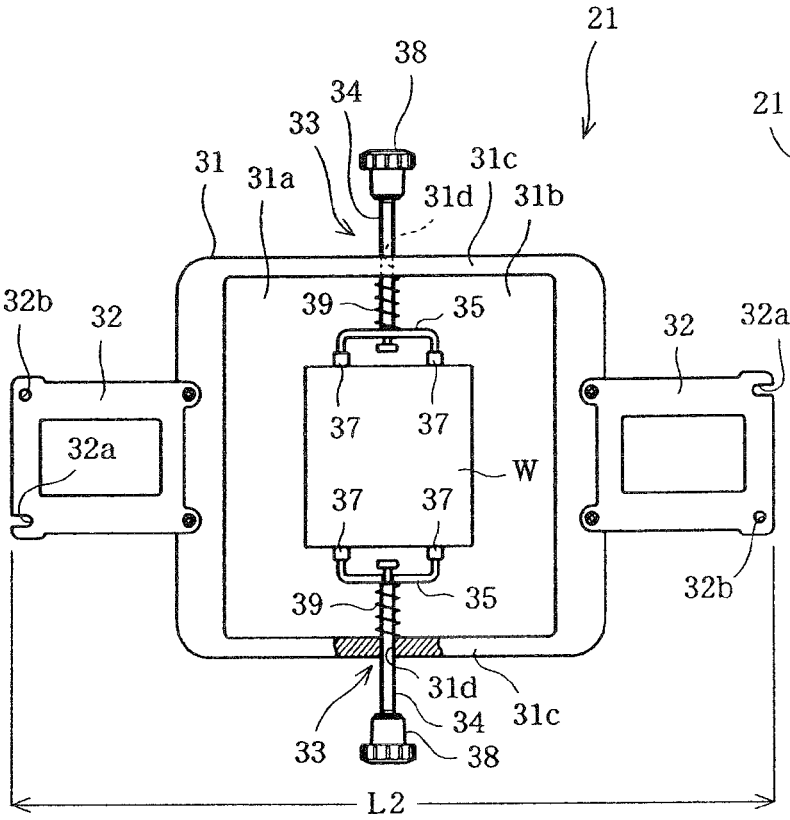
FIGS. 5A, 5B and 5C are plan, front and longitudinal right side section of a workpiece holder respectively.
Figure 5C:
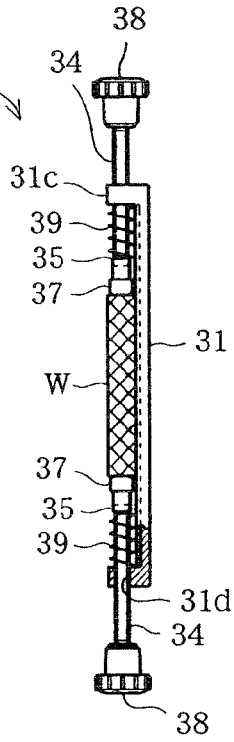
Figure 5B:
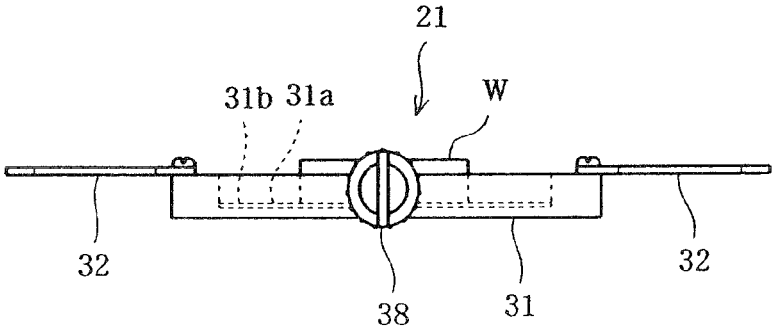

The workpiece holder 21 includes a placement member 31 which is made of a synthetic resin and on which the workpiece W is placed, a pair of right and left connecting members 32 made of a metal and a holding mechanism 33 as shown in FIGS. 5A to 5C. The placement member 31 is generally formed into the shape of a rectangular plate and has a rectangular placement plate 31*a* and a rising wall 31*c* standing on four sides of the placement plate 31*a*. The placement plate 31*a* has an upper surface on which a rubber sheet 31*b* is put. The rubber sheet 31*b* has an effect of absorbing and reducing vibration or oscillation produced during the engraving.

The paired connecting portions 32 are located on the right and left ends of the placement member 31 to be detachably attached to the carriage 19 (the frame holder 24) of the transfer mechanism respectively. The connecting portions 32 are each formed into the shape of rectangular frame and screwed to the rising wall 31*c* constituting the right and left sides of the placement member 31. The connecting portions 32 have rotational symmetry through 180 degrees in a plan view and include respective outer sides in each of which an engagement groove 32*a* and engagement hole 32*b* are formed. Reference symbol "L2" refers to the width between the right and left ends of the workpiece holder 21 or the distance between outer edges of the connecting portions 32 as described above. The distance L2 differs from (is rendered smaller than) the width L1 of any type of embroidery frame.

A holding mechanism 33 is provided for holding the workpiece W so that a part of the workpiece W other than a processed surface (an upper surface) is fixed. The holding mechanism 33 includes pressing members which are provided on the placement member 31 and press front and rear end sides of the workpiece W and support portions which support the pressing members, respectively. In the embodiment, each pressing member comprises a screw member and the support portion comprises a screw hole 31*d*. Two pairs of the screw members 34 and the screw holes 31*d* are opposed to each other with the workpiece W being interposed therebetween in the front-back direction and are symmetric with each other with respect to the front-back direction. The screw holes 31*d* are formed through the central portions of the rising walls 31*c* constituting the front and rear sides of the placement member 31 in the front-back direction.

Each screw member 34 is formed into the shape of a bar elongate in the front-back direction and has a male thread formed on a circumferential surface over an entire length thereof. Each screw member 34 is threadingly engaged with the screw hole 31*d* so as to extend through the rising wall 31*c*. Each screw member 34 has a distal end or an end located inside the placement member 31. An abutting member 35 abuts the distal end of each screw member 34 with a slight play thereby to be supported. As a result, the abutting members 35 are slidable to some degree relative to the screw members 34 respectively. The abutting members 35 extend right and left from the distal ends of screw members 34 and have distal ends bent at about 90 degrees thereby each to be formed into a C-shape in a plan view. The workpiece W is adapted to abut the right and left distal ends of each abutting member 35, on which ends two antislip members 37 made of a rubber or a resin each having a high friction coefficient are provided.

Two knobs 38 are mounted on distal ends 34 located outside the placement members 31 respectively. The screw members 34 can be moved in the front-back direction when the user turns the knobs 38. Accordingly, the workpiece W can be held so as to be interposed between the two screw members 34 in the front-back direction with the workpiece W being placed in the center of the placement member 31.

There is a case where the workpiece W is not rectangular in shape as shown in FIG. 5A or the like but the front or rear side of the workpiece W is inclined with respect to the X direction, for example. In this case, the abutting members 35 are inclined to some degree according to the shape of the workpiece W, whereupon the workpiece W can be supported stably. Furthermore, the antislip members 37 each having a high frictional coefficient are mounted on the distal ends of the abutting members 35 respectively. As a result, the workpiece W can be held strongly without displacement.

Two compression coil springs 39 each serving as an elastic member are provided around the peripheries of the screw members 34 so as to be located between the abutting members 35 and the rising walls 31*c* of the placement members 34 respectively. Each spring 39 imparts an external urging force between the abutting member 35 and the rising wall 31*c*. The urging force normally retains the backlash between the screw member 34 and the screw hole 31*d* in one direction, whereupon the screw member 34 can be prevented from being loosened relative to the screw hole 31*d*. Nuts may be used instead of the springs 39. More specifically, each single nut is threadingly engaged with the screw member 34 and pressed against the rising wall 31*c* of the placement member while the holding mechanisms 33 hold the workpiece W therebetween.

Thus, this structure serves as a double nut and can prevent each screw member 34 from being loosened relative to the screw hole 31*d*.

The following will describe the frame holder 24 to which the aforesaid embroidery frame 20 and workpiece holder 21 are connected. The frame holder 24 includes a holder body 40 fixedly mounted to an upper surface of the X-direction carriage 23 and a movable arm 41 which is mounted on the holder body 41 so as to be displaceable, as shown in FIG. 4. The movable arm 41 is displaced according to the type of the embroidery frame 20 or the workpiece holder 21 to be attached, namely, the width L1 (L2) by the user. The holder body 40 has a main portion 42 which is formed into the shape of a plate elongate in the X direction (the right-left direction). The main portion 42 has a right arm 43 which is bent substantially at right angles and extends forward. The right arm 43 has an upper surface provided with a first engagement pin 47 located on a distal end thereof. The upper surface of the right arm 43 further has a leaf spring 44 which is located in the rear of the first engagement pin 47 and provided for holding the connecting portions 32. The first engagement pin 47 is engaged with an engagement groove 30*a* of the connecting portion 30 of the embroidery frame 20 or an engagement groove 32*a* of the connecting portion 32 of the workpiece holder 21.

The movable arm 41 is formed so as to be bilaterally symmetric with the right arm 43 and has a proximal end (a rear end) mounted on the left upper surface of the main portion 42 of the holder body 40 so as to overlap the surface. The movable arm 41 has an upper surface provided with a second engagement pin 47 located on a distal end thereof. The upper surface of the movable arm 41 further has a leaf spring 48 which is located in the rear of the second engagement pin 47 and provided for holding the connecting portions 30 and 32. The second engagement pin 47 is engaged with an engagement groove 30*b* of the connecting portion 30 of the embroidery frame 20 or an engagement groove 32*b* of the connecting portion 32 of the workpiece holder 21.

The movable arm 42 has a proximal end formed with an elongate guide groove 49 which is elongate in the right-left direction. A guide pin 50 is mounted on the upper surface of the main portion 42 of the holder body 40. The guide pin 50 is engaged with the guide groove 49. As a result, the movable arm 41 is slidable in the right-left direction relative to the main portion 42 of the holder body 40. Furthermore, the main portion 42 of the holder body 40 is provided with a positioning and fixing mechanism (not shown) which selectively fixes the movable arm 41 at one of a plurality of predetermined positions. When the user operates the positioning and fixing mechanism, the position of the movable arm 41 in the right-left direction is changeable.

As the result of the above-described construction, the user attaches the embroidery frame 20 or the workpiece holder 21 to the frame holder 24 while the movable arm 41 is fixed to a suitable position according to the type of the embroidery frame 20 or the workpiece holder 21 to be attached, that is, the width. In attachment of the embroidery frame 20, the connecting portions 30 of the embroidery frame 20 are inserted between the movable arm 41 and the leaf spring 48 and between the right arm 43 and the leaf spring 44 from the front respectively as exemplified in FIG. 4. The engagement hole 30*b* of the connecting portion 30 is then engaged with the second engagement pin 47 of the movable arm 41, and the engagement groove 30*a* of the connecting portion 30 is engaged with the first engagement pin 47 of the right arm 43. As a result, the embroidery frame 20 is held by the frame holder 24 and moved in the X or Y direction by the carriage 19. The workpiece holder 21 can also be attached to the frame holder 24 in the same manner as described above.

Figure 6:
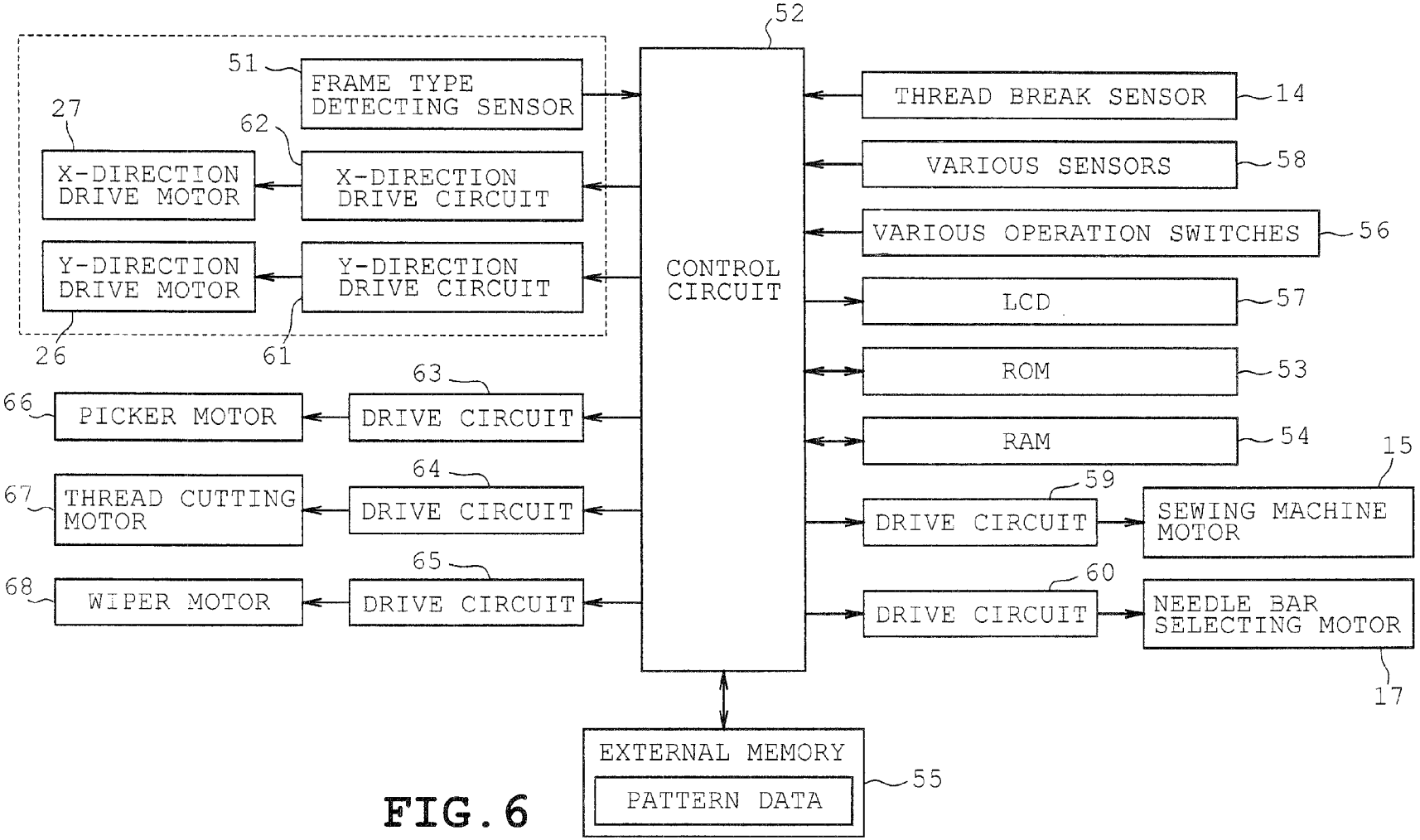
FIG. 6 is a block diagram schematically showing an electrical arrangement of the multi-needle embroidery sewing machine.

A frame type detector 51 is mounted on the X-direction carriage 23 for detecting the embroidery frame 20 or the workpiece holder 21 attached to frame holder 24 based on a detected position of the movable arm 41, as shown in FIGS. 4 and 6. The frame type detector 51 comprises a rotary potentiometer, for example, and has a detecting element which abuts a detected portion comprising an inclined surface provided on the movable arm 41, for example. The frame type detector 51 changes a resistance value and accordingly an output voltage value according to variations in a rotational angle of the detecting element depending upon the position of the movable arm 41 with respect to the right-left direction.

An output signal generated by the frame type detector 51 is delivered to a control circuit 52 which will be described later, as shown in FIG. 6. The control circuit 51 then determines the frame type between the embroidery frame 20 and the workpiece holder 21. Accordingly, the frame type detector 51 and the control circuit 52 constitute a detection processing section which detects whether the workplace holder 21 has been attached to the frame holder 24.

In the embodiment, the sewing machine body 1 can execute an engraving operation as well as a normal embroidery sewing operation with the use of a workpiece cloth and six colors of embroidery threads. In the engraving operation, the striking needle 10 is struck against the surface of the engraving workpiece W in dots while the workpiece holder 21 is transferred in the X or Y direction by the transfer mechanism 18, whereby a desired photograph, illustration or character is engraved on the workpiece W. In execution of the engraving operation, the striking needle 10 is attached to the left end needle bar 8 (needle bar No. 6) instead of the needle 9 as shown in FIG. 2.

The striking needle 10 includes a proximal end (an upper end) having a mounting portion which is mounted on the needle bar 8 and a distal end (a lower end) which is formed into an acuate shape suitable for the engraving, as shown in FIGS. 3A and 3B. The striking needle 10 is struck against the surface of the workpiece W held by the workpiece holder 21 when the needle bar 8 occupies a lowermost position (a bottom dead point). Thus, since the striking needle 10 is not caused to pass through the workpiece W, it is shorter than the needle 9.

Figure 7:
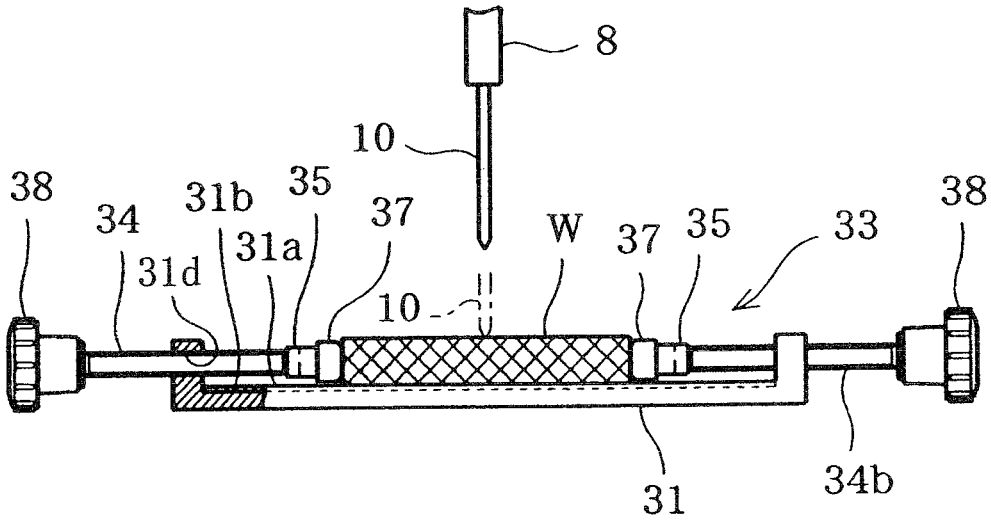
FIG. 7 shows the uppermost and lowermost points of the striking needle.

The holding mechanism 33 is located lower than the distal end of the needle when the striking needle 10 is located at the lowermost point, as shown in FIG. 7. Accordingly, the striking needle 10 can be prevented from interference with the holding mechanism 33. More specifically, the striking needle 10 or the holding mechanism 33 can reliably be prevented from breakage due to collision of them. A plurality of types of striking needles 10 which differ in the length, width or a shape of the distal end, although not shown. One of the striking needles 10 is selected by the user and attached to the needle bar 8 of No. 6. Furthermore, as shown in FIG. 2, the presser foot 11 is detached regarding the needle bar 8 to which the striking needle 10 is attached. When the striking needle 10 is attached to the needle bar 8 of No. 6, the embroidery operation is executed using the remaining needles 8 of Nos. 1 to 5.

The control circuit 52 as shown in FIG. 6 is mainly composed of a computer (CPU), and a ROM 53, RAM 54 and an external memory 55 are connected to the computer. The ROM 53 stores an embroidery sewing control program, an engraving control program, an engraving pattern data generating program and various control data. The external memory 55 stores data of a number of types of patterns for embroidery sewing and data of patterns for engraving.

Operation signals are delivered from various operation switches 56 of the operation panel into the control circuit 52. A liquid crystal display 57 is controlled by the control circuit 52. In this case, while viewing displayed contents on the liquid crystal display 57, the user can operate the switches 56. As a result, a sewing mode such as an embroidery sewing mode, an engraving mode, an engraving mode pattern data generating mode or the like is selected, or a desired embroidery pattern or engraving pattern is selected and designated.

Furthermore, to the control circuit 52 are supplied detection signals generated by the thread break sensor 14, the frame type detector 51 of the transfer mechanism and other detectors 58. The control circuit 52 then controls the drive circuit 59 to control the sewing machine motor 15 and further controls the drive circuit 60 to control the needle bar selecting motor 17. Furthermore, the control circuit 52 controls a Y-direction drive circuit 61 to control the Y-direction drive motor 26 of the transfer mechanism 18 and also controls an X-direction drive circuit 62 to control the X-direction drive motor 27. As a result, the frame holder 24 and accordingly the embroidery frame 20 or the workpiece holder 21 can be moved freely. The control circuit 52 further controls drive circuits 63 to 65 to control a picker motor 66 serving as a drive source of a picker (not shown), a thread cutting motor 67 serving as a drive source of a thread cutting mechanism and a wiper motor 68 serving as a drive source of a wiper (not shown), thereby executing a thread cutting operation.

The picker and wiper will briefly be described. Since the thread cutting mechanism is well known in the art, the description of the thread cutting mechanism will be eliminated. The picker is operated so as to abut a thread capturing hook when an embroidery sewing starts or thread is cut. The picker prevents a needle thread end from coming out of the upper surface of the workpiece cloth (or remaining) in the start of sewing, thereby preventing the needle thread from dropping out of the eye of the needle. The wiper is operated to raise the thread end of the needle thread cut by the thread cutting mechanism onto the upper surface of the workpiece cloth. This operation of the wiper is referred to as "thread wiping operation."

Upon execution of the embroidery sewing control program (the embroidery sewing mode), the control circuit 52 controls the sewing machine motor 15, the needle bar selecting motor 17, the Y-direction and X-direction drive motors 26 and 27 of the moving mechanism and the like, based on embroidery sewing pattern data stored on the external memory, for example. Thus, the embroidery sewing operation is automatically executed with the workpiece cloth being held by the embroidery frame 20. In this case, as well known, the embroidery sewing pattern data includes one stitch data (transfer data) indicative of needle location for every stitch or amounts of movement of the embroidery frame 20 in the X-direction and Y-direction, colors of embroidery threads, namely, color change data instructing change of the needle bar 8 to be driven, thread cutting data instructing a thread cutting operation, sewing end data and the like. The one stitch data includes data of understitching in which stitches do not come out although the stitches are formed in order that the thread may be fed without being cut or embroidery may be reinforced, that is, stitches are finally concealed by other embroidery stitches.

In the embodiment, the control circuit 52 executes an engraving control program thereby to execute an engraving mode based on engraving pattern data. In the engraving mode, the control circuit 52 controls the sewing machine motor 15, the needle bar selecting motor 17, and the Y-direction and X-direction drive motors 26 and 27, thereby automatically executing an engraving operation with use of the striking needle 10 on the surface of the engraving workpiece W held by the workpiece holder 21. In the engraving operation, the needle bar 8 of No. 6 is selected, and the workpiece W to be engraved is repeatedly moved to a next engraving point during upward movement of the needle bar 8 while the striking needle 10 is moved up and down, thereby executing the engraving operation. The aforesaid engraving pattern data is mainly composed of a set of transfer data indicative of a location of struck point by the striking needle 10 for every stitch, that is, amounts of movement in the X and Y directions of the workpiece W to be engraved for every stitch.

The control circuit 52 executes the engraving operation under the condition that attachment of the workpiece holder 21 to the frame holder 24 has been detected by the frame type detector 51 as will be described later with reference to the flowchart of FIG. 9. More specifically, when attachment of the workpiece holder 21 to the frame holder 24 has not been detected by the frame type detector 51, the control circuit 52 forbids the sewing operation or start-up of the sewing machine motor 15 even when the user has instructed execution of the engraving operation.

Furthermore, the control circuit 52 can realize a function of generating and processing section which generates engraving pattern data from pattern data of embroidery pattern, by the execution of the engraving pattern data generation program, as will also be described later with reference of the flowchart of FIG. 9. The engraving pattern data is generated by extracting only transfer data to drive the carriage 19 from pattern data of the embroidery pattern in order that the same pattern as the embroidery pattern may be engraved. In this case, the color change data and the thread cutting data are eliminated from the pattern data, and the understitching data is eliminated from the one stitch data.

The control circuit 52 controls to forbid operations specific to the embroidery sewing operation when attachment of the workpiece holder 21 has been detected by the frame type detector 51, that is, during execution of the engraving operation. The aforesaid operation specific to the embroidery sewing operation includes a thread cutting operation by the thread cutting mechanism, a thread wiping operation by the wiper and a thread break detecting operation by the thread break sensor 14, for example. Furthermore, it is desirable that a driving speed of the needle bar 8 in the engraving operation or a rotational speed of the main shaft be lower (800 rpm, for example) than a maximum speed (1,000 rpm, for example) in the embroidery sewing operation. Driving the needle bar 8 at a speed exceeding the maximum speed in the engraving operation is also specific to the embroidery sewing.

Figure 8:
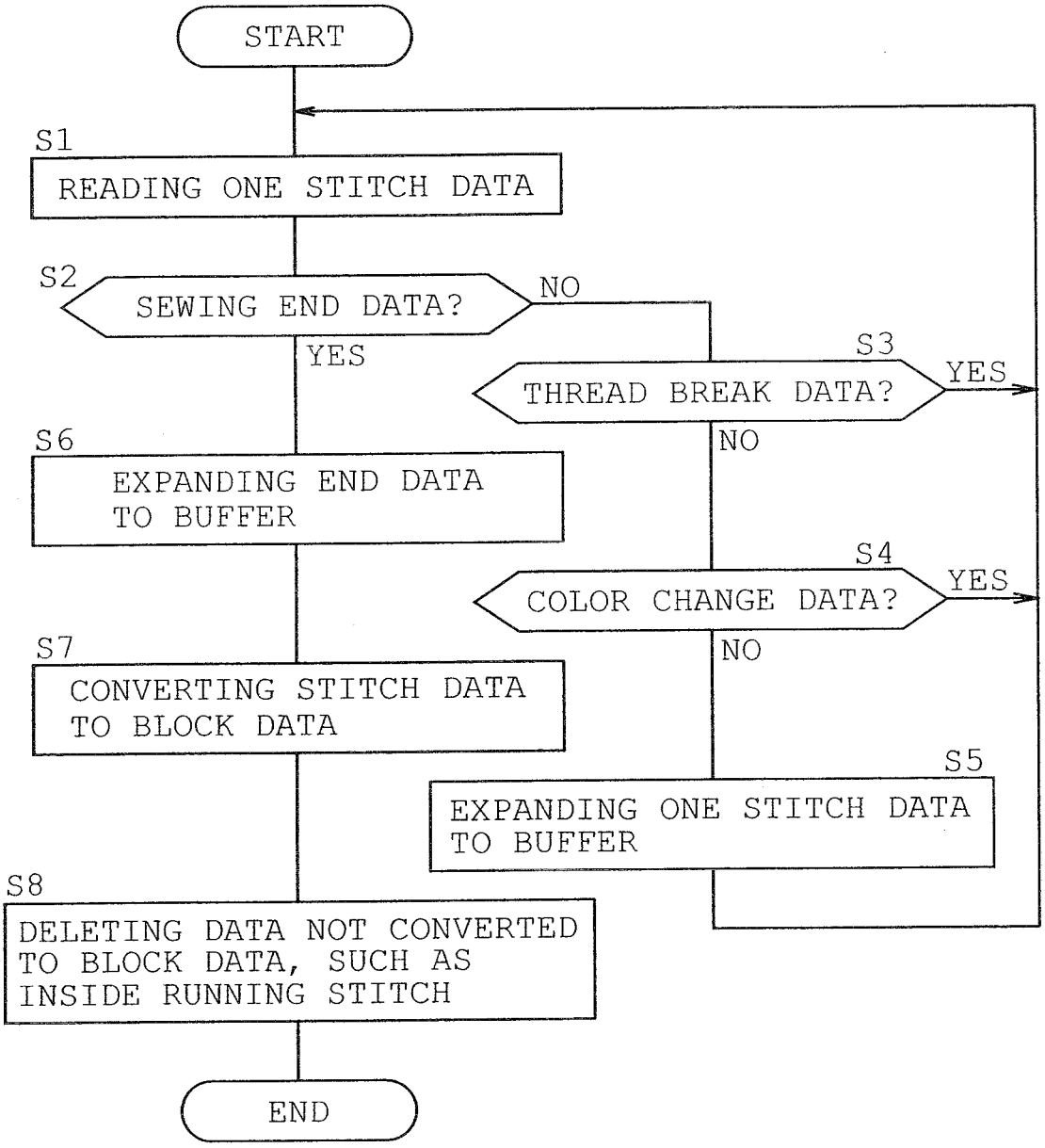
FIG. 8 is a flowchart showing a processing procedure for generating engraving pattern data.

The working of the workpiece holder will be described with reference to FIGS. 8 and 9 as well as FIGS. 1 to 7. For example, in response to a selecting instruction from the user, the control circuit 52 executes processing to generate engraving pattern data by extracting only the transfer data to drive the carriage 19 from embroidery sewing pattern data recorded on the external memory 55 or the ROM 53 (an engraving pattern data generating mode).

In the generation of the engraving pattern data, the user operates various switches 56 to instruct generation of engraving pattern data. With this, the user selects a desired one of embroidery patterns stored as pattern data on the ROM 53 or the external memory 55. FIG. 8 shows a processing procedure for generating engraving pattern data executed by the control circuit 52. More specifically, firstly, one stitch data is read sequentially from the selected pattern data, at step S1. The type of data read at step S1 is determined at steps S2 to S4. The control circuit 52 determines at step S2 whether the read data is sewing end data. When the read data is not the sewing end data (step S2: NO), the control circuit 52 advances to step S3 to determine whether the read data is thread cutting data. When the read data is the thread cutting data (step S3: YES), the control circuit 52 returns to step S1 to read next data. When the read data is not the thread cutting data (step S3: NO), the control circuit 52 advances to step S4 to determine whether the read data is the color change data. When the read data is the color change data (step S4: YES), the control circuit 52 returns to step S1 to read next data.

When the read data is not the color change data (step S4: NO), it can be determined that the read data is the one stitch data (transfer data). Accordingly, the control circuit 52 advances to step S5 to expand the one stitch data to a buffer. The control circuit 52 then returns to step S1 to read next data. The above-described processing is repeated such that the needle location for every stitch or only the transfer data indicative of amounts of X-direction and Y-direction movement of the carriage 19 is extracted and extended to the buffer. When final sewing end data has been read (step S2: YES), the control circuit 52 advances to step S6 to extend the end data to the buffer. Subsequently, the control circuit 52 advances to step S7 to convert stitch data to block data, that is, data to execute engraving sequentially for every one block of pattern. The control circuit 52 further advances to step S8 to delete data of understitching such as inner running stitches, ending the processing for generating engraving pattern data.

The engraving pattern data is thus generated and comprises a set of data indicative of a strike location of striking needle 10 for every one stitch for the purpose of engraving the embroidery pattern on the surface of the engraving workpiece W, that is, amounts of movement of the carriage 19 or workpiece holder 21 in the X-direction and Y-direction. In this case, pattern data for embroidery sewing can be converted to the engraving pattern data. Consequently, the processing for generating engraving pattern data can be rendered easier. The engraving pattern data may be stored on the external memory 55 or the ROM 53 or may be generated by another external data generating device such as a personal computer and supplied to the sewing machine body 1.

According to the above-described multi-needle embroidery sewing machine, the user attaches the sewing needles 9 to five needle bars 8 except the needle bar 8 of No. 6 or all the six needle bars 8 respectively. The embroidery frame 20 holding the workpiece cloth serving as the workpiece is attached to the frame holder 24. The embroidery sewing operation is then executed. In the embroidery sewing operation, the control circuit 52 controls the carriage 19 and the needle bar selecting motor 17 based on the pattern data so that the needle bars 8 to which sewing needles 9 are attached respectively are selectively driven while the embroidery frame 20 is transferred freely in the X and Y directions.

Furthermore, the user attaches the striking needle 10 to the needle bar 8 of No. 6 and also attaches the workpiece holder 21 holding the engraving workpiece W to the frame holder 24. As a result, the engraving operation is executable. In this case, the control circuit 52 controls the carriage 19 based on the engraving pattern data so that the workpiece holder 21 and accordingly the engraving workpiece W are transferred freely in the X and Y directions. With this, the specified needle bar 8 of No. 6 to which the striking needle 10 is attached is selectively driven by the needle bar selecting motor 17 so that the engraving operation is executed. A pattern according to the engraving pattern data is engraved on the surface of the workpiece W by the striking needle 10.

There is a possibility that the embroidery sewing operation with the use of the sewing needles 9 may be executed as the result of erroneous operation by the user while the workpiece holder 21 is mounted on the frame holder 24. Upon occurrence of the case, the needle 9 would butt the workpiece W or workpiece holder 21 such that the needle 9, workpiece W and/or workpiece holder would be damaged. Furthermore, in the case where the engraving operation by the striking needle 10 is executed while the embroidery frame 20 holding the workpiece cloth is mounted on the frame holder 24, there is a possibility that the workpiece cloth may be damaged by the striking needle 10.

Figure 9:
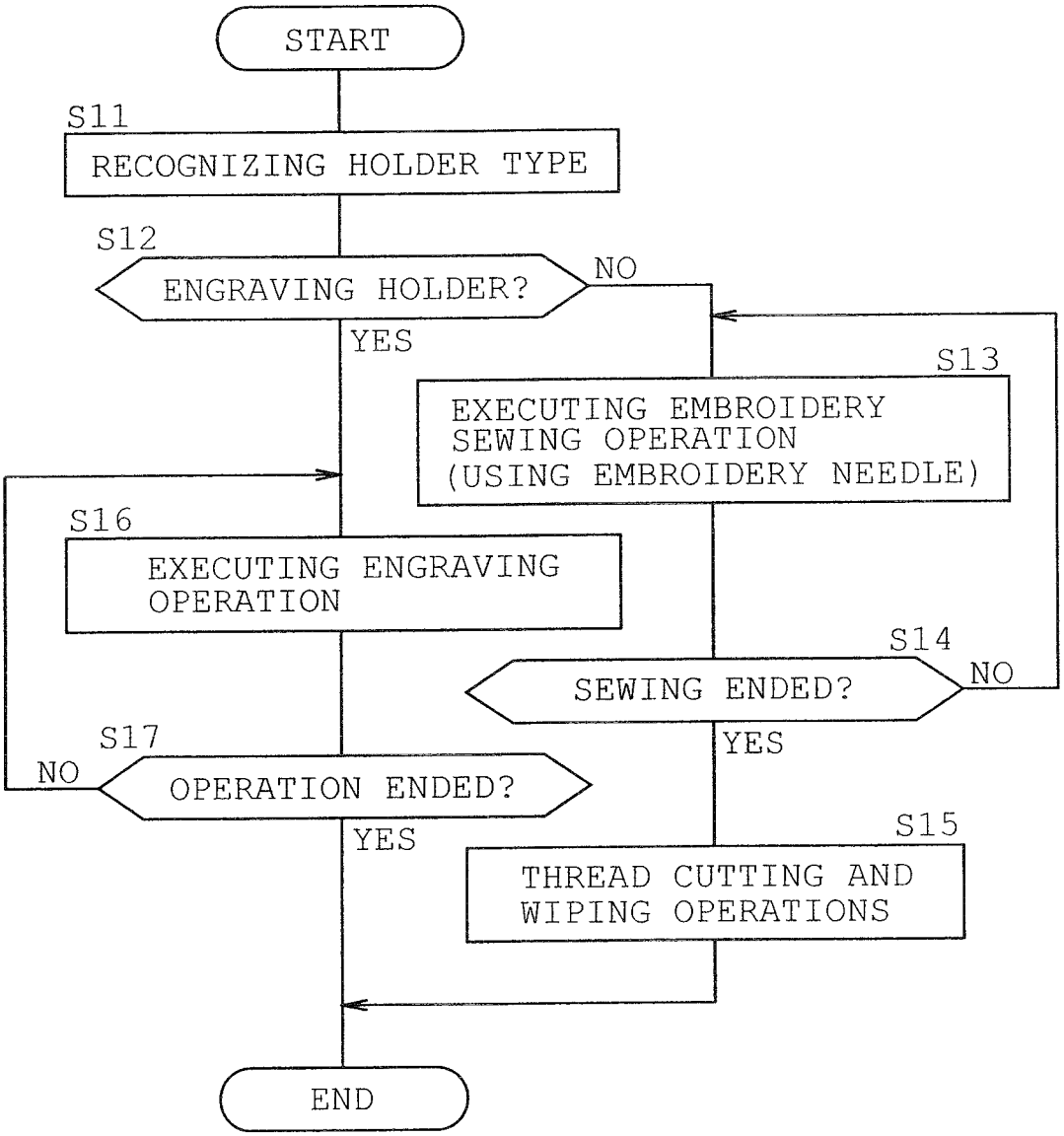
FIG. 9 is a flowchart showing a processing procedure for needle bar control executed by a control circuit.

In view of the above-mentioned problem, the control circuit 52 is arranged to control the operation of the sewing machine body 1 based on the detection by the frame type detector in starting the operation or start-up of the sewing machine motor 15, as shown in the flowchart of FIG. 9. More specifically, the control circuit 52 recognizes the type of the embroidery frame 20 or the workpiece holder 21 based on an output signal of the frame type detector 51, at step S11. The control circuit 52 advances to step S12 to determine whether the workpiece holder 21 has been attached. The following control manner differs depending upon which is attached, the embroidery frame 20 or the workpiece holder 21.

When determining that the workpiece holder 21 has not been attached, that is, when the embroidery frame 20 has been attached (step S12: NO), the control circuit 52 advances to step S13 to execute the embroidery sewing operation by the needles 9 up to the end of the sewing. Upon completion of the sewing (step S14: YES), the control circuit 52 advances to step S15 to execute the thread cutting operation and the thread wiping operation by the wiper, ending the processing. In this case, since the type of the embroidery frame 20 can be detected in the recognition at step S11, the control can be carried out according to the mounted embroidery frame 20, for example, an error is informed of the user when the size of the selected pattern data is larger than a sewing area (shown by two-dot chain line in FIG. 4) of the embroidery frame 20.

On the other hand, when detecting that the workpiece holder 21 has been attached to the frame holder 24, based on an output signal of the frame type detector 51 (step S12: YES), the control circuit 52 advances to step S16 to execute the engraving operation by the striking needle 52. When determining that the engraving operation has been completed, that is, when the end data has been read (step S17: YES), the control circuit 52 ends the operation. Furthermore, an error is also informed of the user when the embroidery sewing operation is executed although the workpiece holder 21 has been attached to the frame holder 24, or when the engraving operation is executed although the frame holder 20 has been attached to the frame holder 24.

The above-described control manner by the control circuit 52 can prevent upward and downward movement of the needle bars 8 of Nos. 1 to 5 to which the respective sewing needles 9 are attached, with the workpiece holder 21 being attached to the frame holder 24. Furthermore, the engraving operation can be prevented from being executed based on the pattern data for embroidery sewing. On the other hand, when the embroidery frame 20 is attached to the frame holder 24, the needle bar 8 to which the striking needle 10 is attached can be prevented from being moved upward and downward and the embroidery sewing operation can be prevented from being executed based on the engraving pattern data. Additionally, the operation specific to the embroidery sewing operation can be forbidden while the frame type detector 51 is detecting attachment of the workpiece holder 21, as described above.

The following advantages can be achieved from the foregoing embodiment. The striking needle 10 can be attached to the specific needle bar 8, and the workpiece holder 21 holding the workpiece 19 can be transferred by the carriage 19 based on the engraving pattern data. Accordingly, the engraving operation can be executed onto the surface of the workpiece W in addition to the embroidery sewing operation onto the workpiece cloth. Consequently, the multi-needle embroidery sewing machine can be used as an engraving device. Since the control to execute the engraving operation is carried out while the frame type detector is detecting attachment of the workpiece holder 21, an unsuitable operation which does not correspond to the type of the embroidery frame 21 or the workpiece holder 21 can effectively be prevented from execution.

The holding mechanism is located lower than the distal end of the needle in the case where the striking needle 10 is located at the lowermost point. Accordingly, the striking needle 10 and the holding mechanism 33 are prevented from interference with each other during the engraving operation. Consequently, each of the striking needle 10 and the holding mechanism 33 can reliably be prevented from breakage or the like. Furthermore, the holding mechanism 33 includes the screw member 34 supported by the screw hole 31*d* formed in the placement member 31. Accordingly, the workpiece W is pressed at its side by the screw member 34 supported by the screw hole 31*d*, thereby being held by the holding mechanism 33. Consequently, the workpiece W can reliably be fixed in a stable state by a simple construction, and the operation by the user can be rendered easier.

The abutting member 35 is loosely fitted with the distal end of the screw member 34 thereby to be supported. Consequently, the abutting member 35 can hold the workpiece W according to an inclination of a portion thereof abutting the workpiece W, and the holding mechanism 33 can more reliably hold the workpiece W to be engraved. In the foregoing embodiment, particularly, the engraving pattern data is generated by extracting only the transfer data to drive the carriage 19 from the pattern data. Consequently, when the same pattern as the embroidery pattern is desired to be engraved, the embroidery sewing pattern data can be used as the engraving pattern data, whereupon the processing for generating the engraving pattern data can be rendered easier. Furthermore, when the frame type detector 51 has detected attachment of the workpiece holder 21, the operations specific to the embroidery sewing are controlled so as not to be executed. Accordingly, an unsuitable operation can be prevented from being executed during the engraving operation with the workpiece holder 21 being attached, whereupon the engraving operation can efficiently be carried out.

Figure 10A:
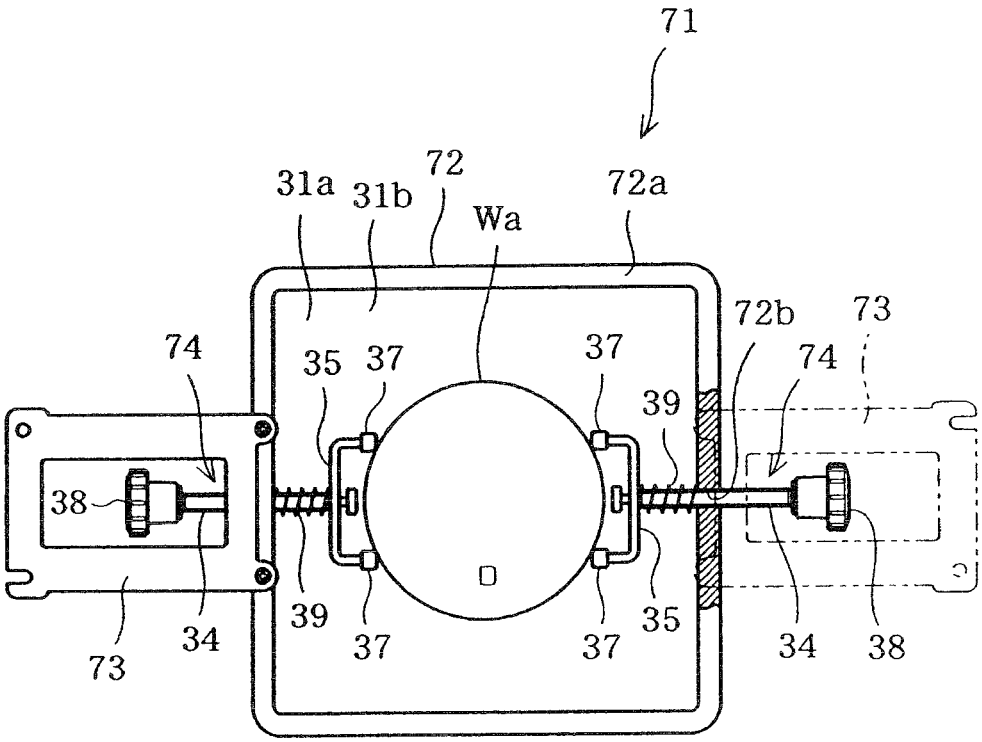
FIGS. 10A and 10B are a plan view and a front view of the workpiece holder of a second illustrative example respectively.
Figure 10B:
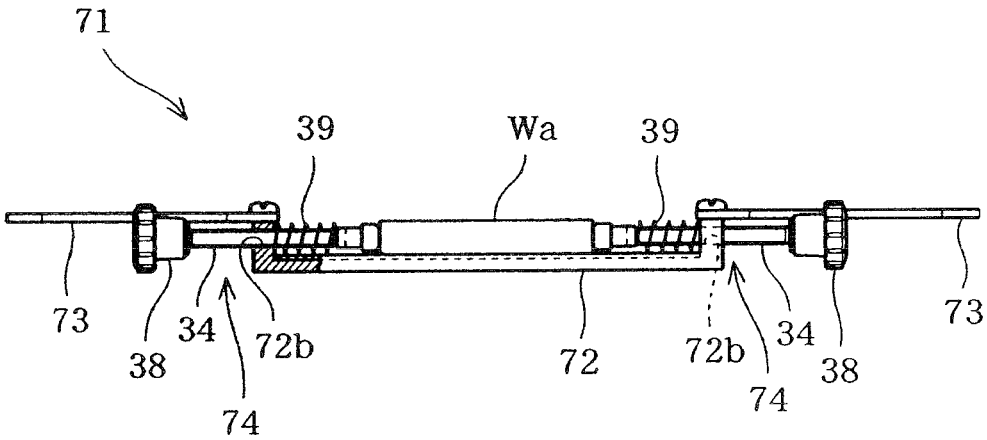

FIGS. 10A and 103 illustrate a second embodiment. Identical or similar parts in the second embodiment are labeled by the same reference symbols as those in the first embodiment and accordingly, description of these parts will be eliminated. Only the difference between the first and second embodiments will be described.

The workpiece Wa to be engraved is made of a plastic or metal plate or a board made of wood or fabric and formed into a circular shape. The workpiece holder 71 includes a placement member 72 which is formed into a rectangular shape and on which the workpiece Wa is placed, two connecting portions 73 mounted on the right and left sides of the placement member 71 and two holding mechanisms 74. The placement member 72 is formed into substantially a square shape and has a rising wall 72*a* rising from the periphery. The connecting portions 73 are secured to upper surfaces of the rising wall 72*a* rising from the right and left sides of the placement member 71 respectively.

Each holding mechanism 74 includes a screw member 34 serving as a pressing member 34 and a screw hole 72*b* formed in the rising wall 72*a*. and serving as a support portion. The paired screw members 34 and the screw holes 72*b* are bilaterally symmetric with each other with the workpiece Wa being interposed therebetween. More specifically, the screw holes 72*b* are formed in the central parts of the rising walls 72*a* located at right and left sides respectively. Furthermore, each screw member 34 includes the abutting member 35, antislip member 37, knob 38 and compression coil spring 39 as in the first embodiment.

According to the second embodiment, the workpiece holder 71 is suitable for holding the workpiece We when used with the multi-needle sewing machine and the engraving operation is executed onto the workpiece Wa as in the first embodiment. The two screw members 34 are provided on the right and left portions of the workpiece holder 71 and located below the respective connecting portions 73. Accordingly, the screw members 34 are prevented from protruding in the front-back direction, whereupon the workpiece holder 71 can be rendered smaller with respect to the front-back direction.

Figure 11:
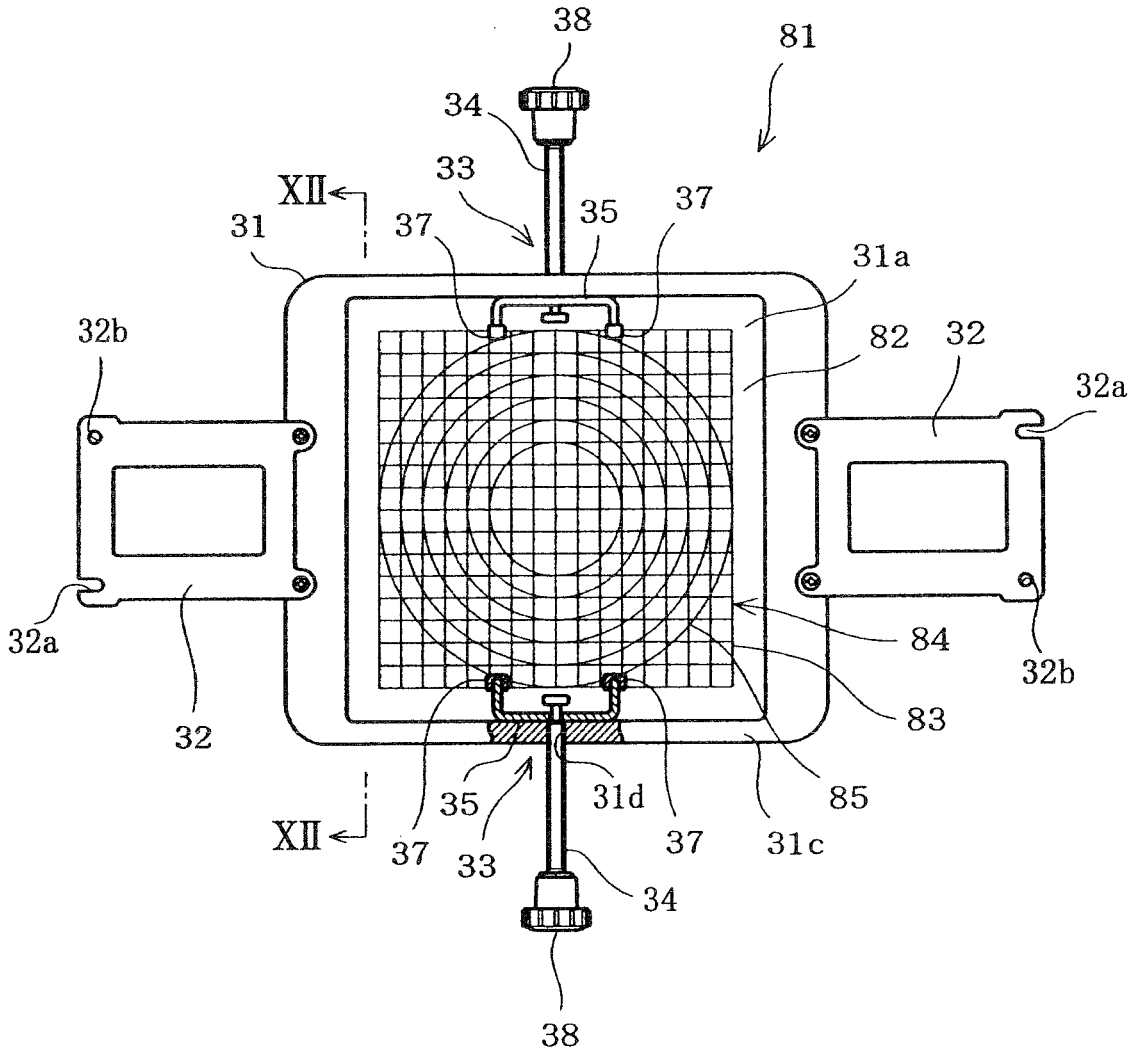
FIG. 11 is a plan view of the workpiece holder of a third illustrative example.
Figure 12:
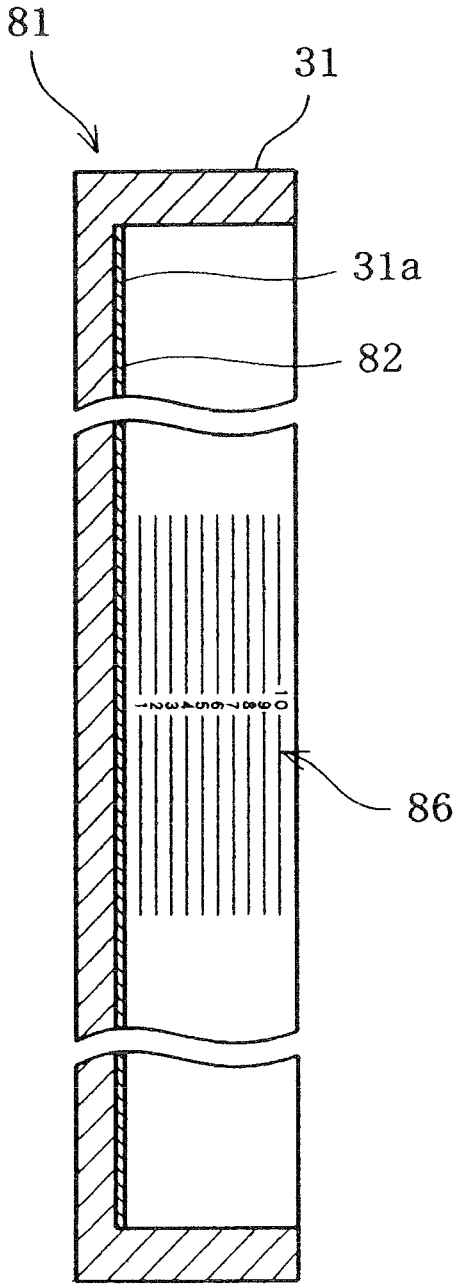
FIG. 12 is a longitudinal side section taken along line A-A in FIG. 11.

FIGS. 11 and 12 illustrate a third embodiment. As shown in FIG. 11, the workpiece holder 81 of the third embodiment includes the placement member 31 which is formed into the shape of a rectangular plate and on which the workpiece W is placed, a pair of the right and left connecting members 32 mounted on right and left sides of the placement member 31, and the holding mechanism 33. The placement member 31 has the rectangular placement plate 31*a* and the rising wall 31*c* standing on four sides of the placement plate 31*a*. The placement plate 31*a* has the upper surface on which a rubber sheet 82 is put. The rubber sheet 82 has an upper surface or a placement surface on which quadrille reference lines are provided at predetermined intervals, for example, at intervals of 5 mm in the front-back and right-left directions as shown in FIG. 11. An area within the reference lines 83 serves as an engravable range 84. Furthermore, symmetrical circular reference lines 85 are drawn about the center of the engravable range 84 so as to overlap the quadrille reference lines 83. The reference lines 85 have respective radii which are increased from 15 mm by 5 mm. The user can easily position the workpiece W on the placement member 31 while the quadrille reference lines 83 and the symmetric reference lines 85 serve as guides.

Straight line scales 86 serving as reference lines are drawn on an inner surface of the rising wall 31*c* of the placement member 31 at predetermined intervals, for example, at intervals of 1 mm so as to extend upward from the surface of the rubber sheet 82 put on the placement plate 31, as shown in FIG. 12. The user can confirm a thickness of the workpiece W to be processed while the line scales 86 serve as guides. The user can further adjust the lowermost point of the distal end of the striking needle 10 while the line scales 86 serve as guides.

In the third embodiment, the workpiece holder 81 is provided with three types of reference lines, namely, the quadrille reference lines 83, the symmetric reference lines 85 and the line scales 86. However, any one or two of them may be provided, instead.

The foregoing embodiments should not be limited and may be expanded and changed in various manners. For example, various changes may be made in the construction of the embroider sewing machine. For example, the number of needle bars 8 provided in the needle bar case 7 may be seven, twelve or the like. Furthermore, even in an embroidery sewing machine provided with a single needle bar, the engraving operation can be executed when the needle is replaced by a striking needle. Furthermore, various changes can be made in the entire construction of the sewing machine body 1, the construction of the carriage 19, the construction of the workpiece holder 21 and the like.

A plurality of types of workpiece holders differing in the size and configuration of the placement member may be prepared so as to be used according to the sizes and configurations of the workpieces. In this case, too, the construction and arrangement of detecting the type of the workpiece holder by the frame type detector can be achieved.

The foregoing description and drawings are merely illustrative and are not to be construed in a limiting sense. Various changes and modifications will become apparent to those of ordinary skill in the art. All such changes and modifications are seen to fall within the scope as defined by the appended claims.

What is claimed is:

1. A workpiece holder which is usable with an embroidery sewing machine including a needle bar movable upward and downward and a transfer mechanism configured to transfer a workpiece in two directions, the workpiece holder being configured to hold the workpiece when the workpiece is engraved by striking the workpiece by a striking needle attached to the needle bar while the workpiece is transferred by the transfer mechanism, the workpiece holder comprising:

a pair of connecting portions detachably attached to the transfer mechanism;

a placement member on which the workpiece is placed; and a holding mechanism which is provided on the placement member and configured to hold a part of the workpiece other than a worked surface of the workpiece which is engraved, so that said part is fixed.

2. The workpiece holder according to claim 1, wherein the holding mechanism is located lower than a distal end of the striking needle occupying a lowermost position in upward and downward movement.

3. The workpiece holder according to claim 1, wherein the holding mechanism includes a pressing member which is configured to press a side of the workpiece and a support provided on the placement member and configured to support the pressing member.

4. The workpiece holder according to claim 2, wherein the holding mechanism includes a pressing member which is configured to press a side of the workpiece and a support provided on the placement member to support the pressing member.

5. The workpiece holder according to claim 3, wherein the pressing member and the support are located at respective positions opposed to each other with the workpiece on the placement member being interposed therebetween.

6. The workpiece holder according to claim 4, wherein the pressing member and the support are located at respective positions opposed to each other with the workpiece on the placement member being interposed therebetween.

7. The workpiece holder according to claim 3, wherein the pressing member is a screw member and the support is a screw hole with which the screw member is threadingly engaged.

8. The workpiece holder according to claim 4, wherein the pressing member is a screw member and the support is a screw hole with which the screw member is threadingly engaged.

9. The workpiece holder according to claim 5, wherein the pressing member is a screw member and the support is a screw hole with which the screw member is threadingly engaged.

10. The workpiece holder according to claim 6, wherein the pressing member is a screw member and the support is a screw hole with which the screw member is threadingly engaged.

11. The workpiece holder according to claim 7, wherein the pressing member has an abutting member which is configured to abut the workpiece, and the abutting member is loosely fitted with a distal end of the screw member thereby to be supported.

12. The workpiece holder according to claim 8, wherein the pressing member has an abutting member which is configured to abut the workpiece, and the abutting member is loosely fitted with a distal end of the screw member thereby to be supported.

13. The workpiece holder according to claim 9, wherein the pressing member has an abutting member which is configured to abut the workpiece, and the abutting member is loosely fitted with a distal end of the screw member thereby to be supported.

14. The workpiece holder according to claim 10, wherein the pressing member has an abutting member which is configured to abut the workpiece, and the abutting member is loosely fitted with a distal end of the screw member thereby to be supported.

15. The workpiece holder according to claim 1, wherein the placement member has a placement surface on which the workpiece is placed and a side, and at least one of the placement surface and the side of the placement member provided with a reference line which serves as an indication of a position where the workpiece is placed.

16. The workpiece holder according to claim 2, wherein the placement member has a placement surface on which the workpiece is placed and a side, and at least one of the placement surface and the side of the placement member provided with a reference line which serves as an indication of a position where the workpiece is placed.

17. The workpiece holder according to claim 3, wherein the placement member has a placement surface on which the workpiece is placed and a side, and at least one of the placement surface and the side of the placement member provided with a reference line which serves as an indication of a position where the workpiece is placed.

18. The workpiece holder according to claim 5, wherein the placement member has a placement surface on which the workpiece is placed and a side, and at least one of the placement surface and the side of the placement member provided with a reference line which serves as an indication of a position where the workpiece is placed.

19. The workpiece holder according to claim 7, wherein the placement member has a placement surface on which the workpiece is placed and a side, and at least one of the placement surface and the side of the placement member provided with a reference line which serves as an indication of a position where the workpiece is placed.

20. The workpiece holder according to claim 11, wherein the placement member has a placement surface on which the workpiece is placed and a side, and at least one of the placement surface and the side of the placement member provided with a reference line which serves as an indication of a position where the workpiece is placed.

* * * * *